United States Patent [19]

Nelson

[11] 4,163,592

[45] Aug. 7, 1979

[54] FURNITURE UNITS WITH L-SHAPED PANEL SUPPORTS

[75] Inventor: George H. Nelson, New York, N.Y.

[73] Assignee: George Nelson & Company, New York, N.Y.

[21] Appl. No.: 841,418

[22] Filed: Oct. 12, 1977

[51] Int. Cl.[2] ..... A47B 27/00

[52] U.S. Cl. ..... 312/194; 312/111; 312/257 R; 312/281; 108/64

[58] Field of Search ..... 312/194, 190, 280, 281, 312/111, 140, 263, 107, 257 R; 52/36, 27; 108/60, 64, 111; 211/186

[56] References Cited

U.S. PATENT DOCUMENTS

| | | | |
|---|---|---|---|
| 2,531,444 | 11/1950 | Lane | 312/211 |
| 2,930,665 | 3/1960 | Budai | 108/64 |
| 3,000,681 | 9/1961 | Long | 312/194 |
| 3,379,482 | 4/1968 | Baggott | 312/250 |
| 3,779,623 | 12/1973 | Motohashi | 312/108 |
| 3,849,950 | 11/1974 | Albinson et al. | 52/27 |
| 3,873,170 | 3/1975 | Scheerhorn et al. | 312/280 |
| 3,931,771 | 1/1976 | Kramer | 108/60 |
| 4,008,872 | 2/1977 | Thompson | 52/27 |
| 4,070,075 | 1/1978 | Morgan | 312/281 |
| 4,073,556 | 2/1978 | Wilson, Jr. | 312/250 |

FOREIGN PATENT DOCUMENTS

| | | | |
|---|---|---|---|
| 814511 | 7/1951 | Fed. Rep. of Germany | 312/108 |
| 1330055 | 12/1963 | France | 312/257 R |

*Primary Examiner*—Victor N. Sakran
*Attorney, Agent, or Firm*—Edward E. Dyson

[57] ABSTRACT

A furniture unit comprising a substantially L-shaped panel which, with other identical panels, is used as a supporting base structure for a variety of different furniture pieces including, but not limited to, desks, sofas or chairs, shelving and the like. The panels are provided with equispaced slots on each of the vertical side edges thereof. Brackets are received in and interlockingly engaged with said slots on each of said vertical edges in selected positions for supporting either a desk top or other element depending upon the use to which the panels are put. The panels are also provided with slots in each of their horizontal edges, said slots being of equal size and spacing such that the panels can be inverted for right-hand or left-hand use. The slots on the lower horizontal edges receive the brackets of a base member, while the slots on the upper horizontal edges receive the brackets for support of any of a number of different ornamental and functional attachments in accordance with the particular application of the panels.

8 Claims, 16 Drawing Figures

Fig. 3
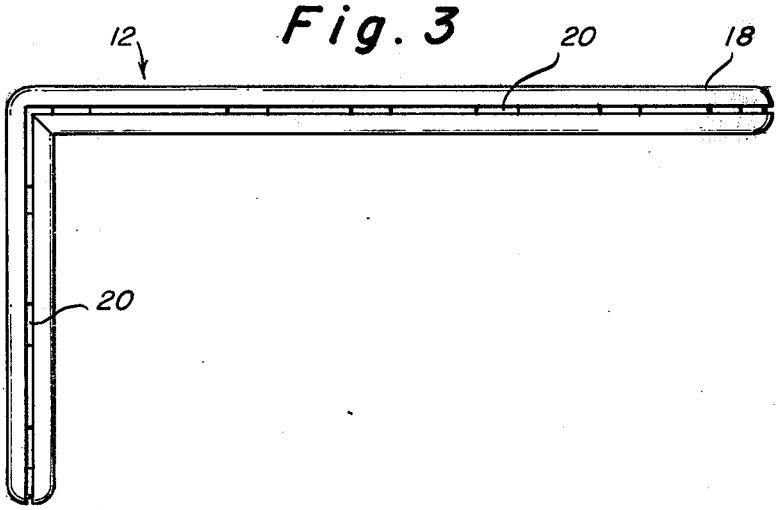
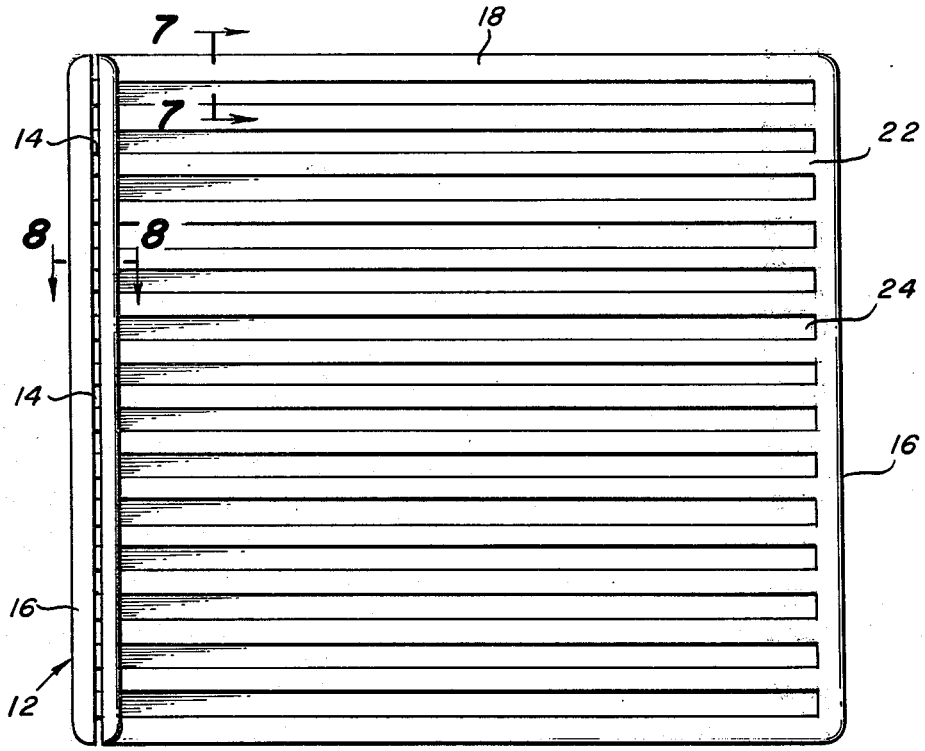
Fig. 4

Fig. 14
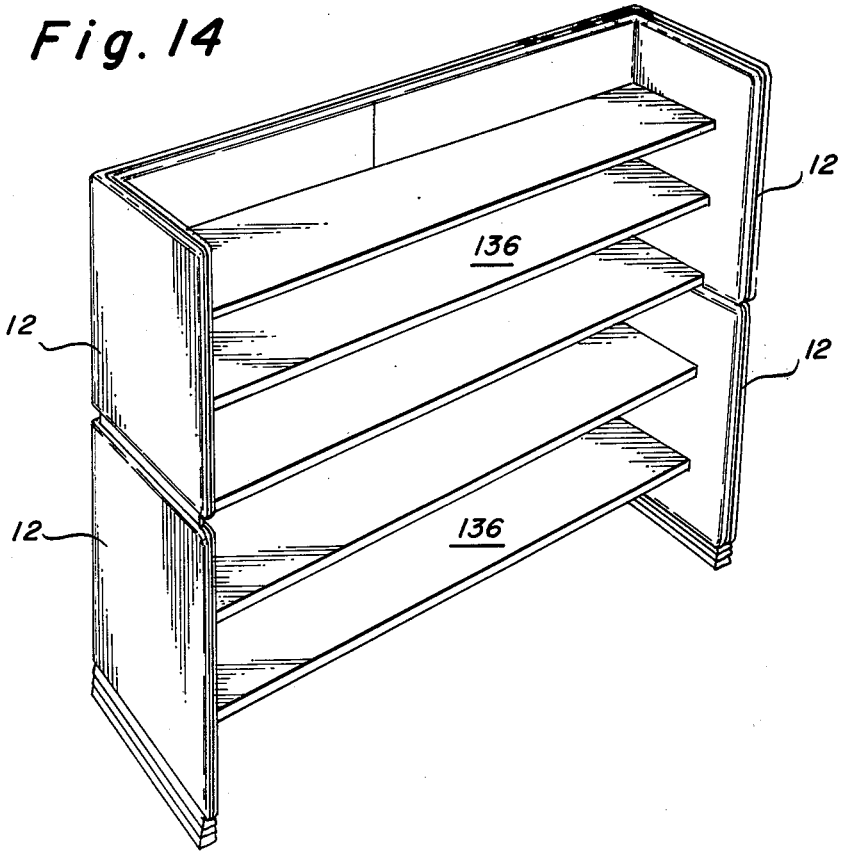
Fig. 13
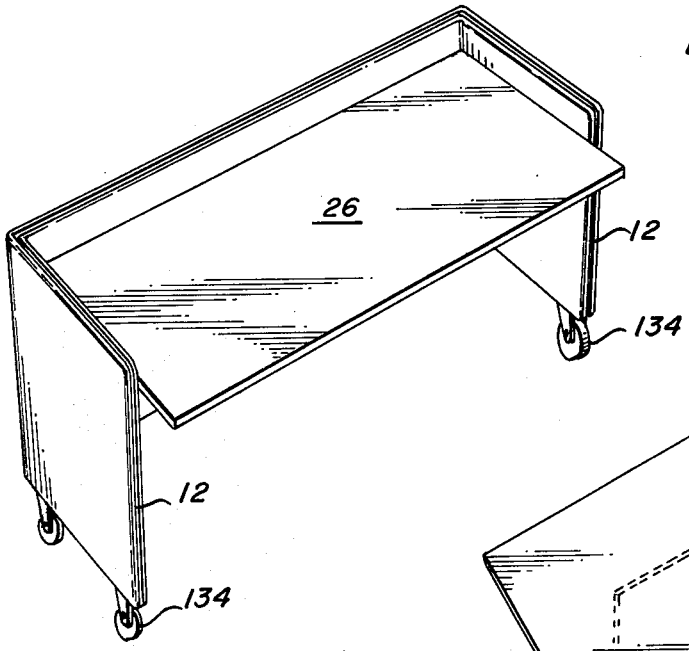
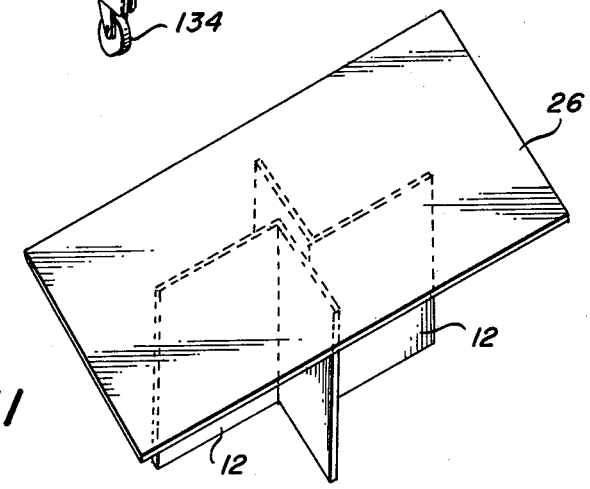
Fig. 11

FURNITURE UNITS WITH L-SHAPED PANEL SUPPORTS

FIELDS OF THE INVENTION

This invention relates to furniture and more particularly to office-type furniture composed of component parts which may be assembled in a number of different configurations and which may be provided with a variety of ornamental and functional accessories.

BACKGROUND OF THE INVENTION

Office furniture is oftentimes selected for a particular type of work and cannot be changed in the event it is desired to put it to a different use in another area of the office. For example, a desk selected as a receptionist desk may not be suitable for the needs of a bookkeeper. Absent interchangeability, however, a desk must be brought for a particular purpose and, accordingly, there are limitations on its use, not to mention its marketability in the event a turnover in furniture is required.

Accordingly, it is desirable to provide furniture which can be structurally modified to suit a particular need and function. It is an objective of this invention to provide such furniture.

The invention includes a pair of free-standing, substantially L-shaped panels, each having a plurality of equispaced slots on its vertical side edges. Each of the horizontal edges of the L-shaped panels is also provided with slots which may be of a different size and spacing than that of the slots on the vertical side edges. Brackets are interlockingly received in the slots in the vertical side edges and are provided with horizontal flanges which support, for example, a rectangular desk top placed thereon.

The L-shaped panels are described and shown herein as being of substantially right-angular configuration; however, it is to be understood that for certain embodiments the overall concept of the invention can be practiced with panels of greater or lesser angles (i.e., 75° or 120°) without departing from the scope of the invention.

Further, the panels will normally be provided with a detachable base, the height of the base and panel, taken together, will be of approximately normal desk height. It is to be understood, however, that the panels may be employed without a base, and the panels can be constructed of any height necessary to suit the particular use to which the panel is put. Another advantage to having removable or detachable bases is that an office area can be laid out using the bases alone, which reduces the time and physical work needed compared to having to shift around the desk as a complete unit.

The modular furniture of this invention is primarily described in the context of a desk. It is to be understood, however, that other furniture constructions can be structured through the application of different combinations of the L-shaped panels and planar supporting surfaces. As shown in the drawings and as will be described later herein, this invention includes but is not limited to such other items of furniture as a mobile cart, shelving, chairs and sofas.

An important feature of this invention is that the L-shaped panels are identical and merely need be inverted to convert a "left-handed" panel into a "right-handed" panel and vice versa.

The use of component parts, including the L-shaped panels, permits furniture structures to be readily added to or otherwise modified. For example, a standard desk unit can be extended into an L-shaped unit by providing another L-shaped panel and an additional or extension desk top extending perpendicularly to the longitudinal axis of the primary desk top. Brackets are inserted into the openings in the side edges of one of the original L-shaped panels and an additional or third panel provides the necessary support for the extension desk top. The slots permit the attachment of many accessories, both functional and ornamental, as will be described in greater detail below.

It is a principal objective of this invention to provide furniture composed of component parts which can be assembled in a number of different configurations and, therefore, satisfy a variety of functions or needs.

It is a further objective of this invention to provide furniture composed of component parts, certain of which are identical, to enhance interchangeability. For example, as pointed out above, the identical L-shaped panels can be converted from a "left-hand" panel to a "right-hand" panel, and vice versa.

It is a further object of this invention to provide furniture which is aesthetically pleasing.

It is still another objective of this invention to provide furniture to which a number of accessories can be readily attached, a feature that is particularly useful with desks.

A further objective of this invention is to provide furniture which can be easily and inexpensively manufactured.

It is still another objective of this invention to provide furniture which can be broken down into a number of component parts for ready shipment or storage.

These and other objectives of the invention will become more apparent to those skilled in the art by reference to the following detailed description when viewed in light of the accompanying drawings wherein:

BRIEF DESCRIPTION OF THE DRAWINGS

FIG. 3 is a plan view of the generally L-shaped panel of the desk of this invention;

FIG. 4 is a side view, in elevation, of the generally L-shaped panel of the desk of this invention;

FIG. 11 is a perspective view of still another modified version of the desk of this invention;

FIG. 13 is a perspective view of a mobile cart of this invention;

FIG. 14 is a perspective view of a shelf arrangement.

DETAILED DESCRIPTION OF THE DRAWINGS

Figure 1:
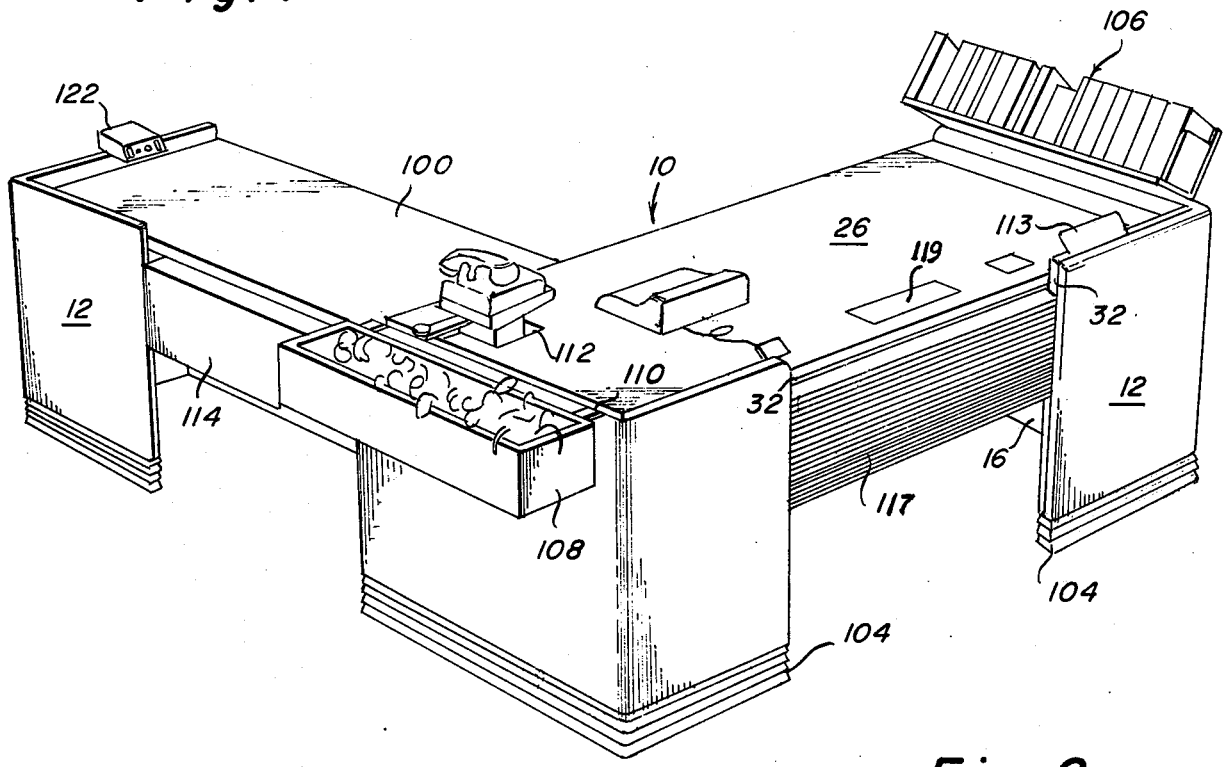
FIG. 1 is a perspective view of an assembled desk of this invention with certain accessories in place.

Referring now to the drawings wherein like numerals indicate like parts, this invention will initially be described in the context of a desk which is generally indicated by the numeral 10. The basic unit of the desk shown in FIG. 1 includes identical L-shaped panels 12. As more clearly shown in FIGS. 3 and 4, each panel is provided with a plurality of slots 14 in each of its vertical side edges 16. The horizontal edges 18 are provided with slots 20 which, as shown, may be of a different size and spacing than that of the slots 14 in the vertical side edges 16.

The panel shown in FIGS. 3 and 4 may be referred to as a "left-hand" panel merely by inverting the panel such that it stands on its opposite horizontal edge. The savings in manufacturing cost and time are substantial by providing a panel which can be used as either a right-hand panel or a left-hand panel as opposed to manufacturing separate right-hand and left-hand panels.

It is to be understood that the panels may be constructed of any suitable material such as plastic, leather, metal, cloth, wood or the like, and may be of any suitable size without departing from the scope of the invention. It is to be understood further that while the panels are shown and described as being substantially right-angular (90°), the panels may, in embodiments to be described later herein (such as those where the panels completely underlie the desk top), be of greater or lesser angles. Such panels could also be used with the desks shown in FIGS. 1 and 2 provided that the ends of the desk top are angulated to conform to the angle of the panels since the latter wrap around the ends of the desk top.

The panel is provided with a liner 22 which has a series of indentations 24 and is preferably of a relatively soft material for sound attenuating purposes.

Figure 2:
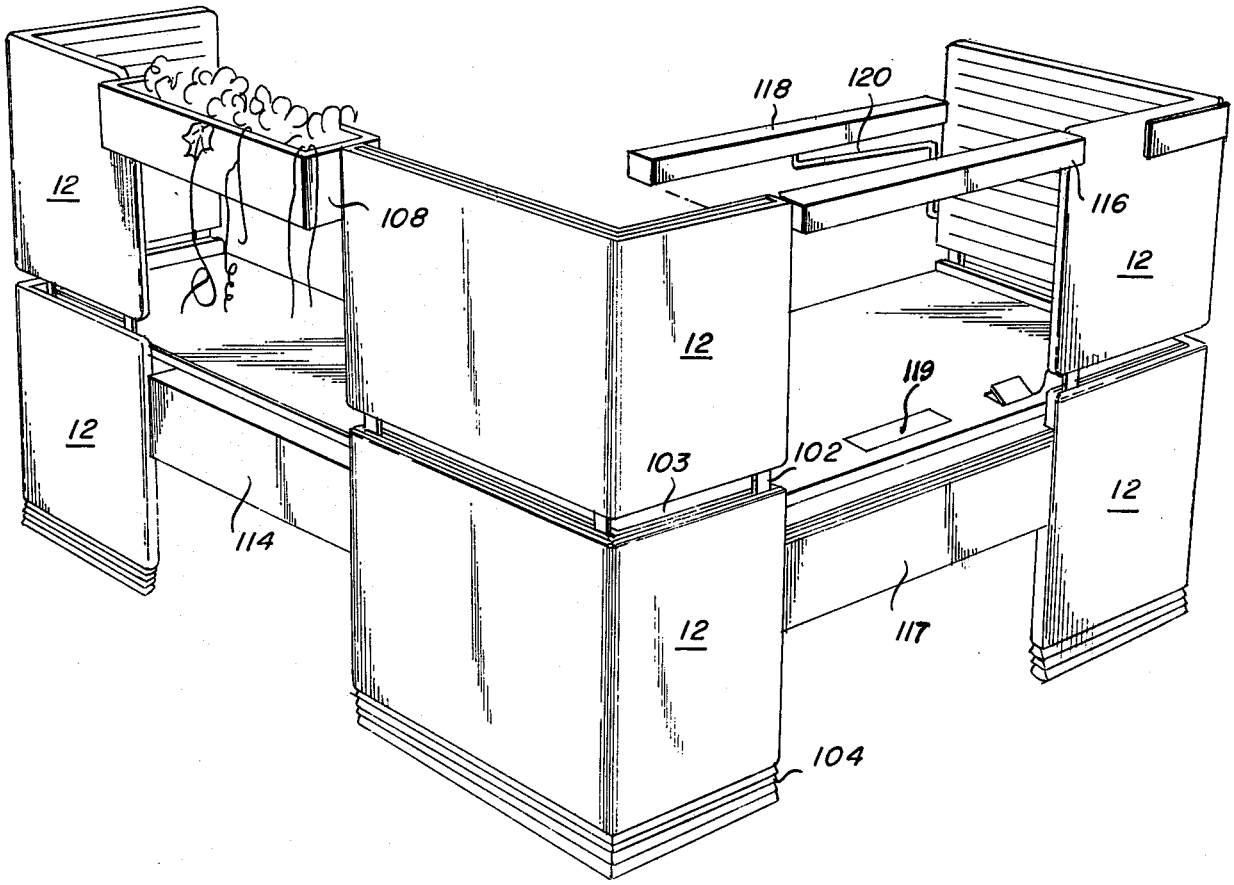
FIG. 2 is a perspective view of the desk of this invention with still more accessories in place thereon.
Figure 5:
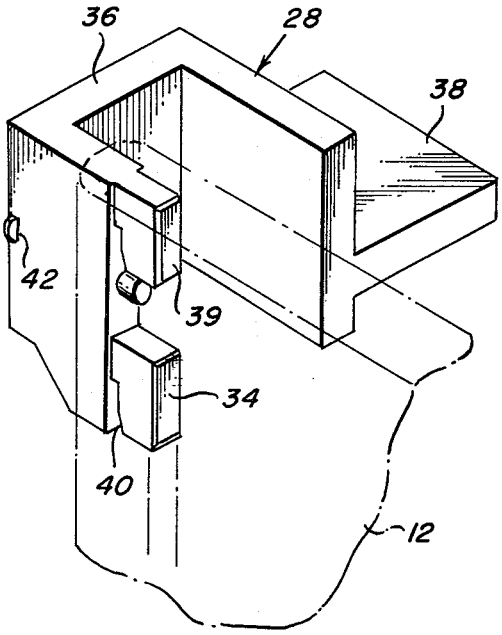
FIG. 5 is a perspective view of one of the brackets employed in supporting the desk top on one of the generally L-shaped panels of the desk of this invention.

The basic desk of FIG. 1 consists essentially of four elements: two L-shaped panels (which form 90° angles in the embodiment shown in FIG. 1), a desk top and a set of brackets which are attached to the panels for supporting the desk top. The desk top 26, shown in FIG. 1, is supported on corner panels by means of brackets 28 and 30 shown in FIGS. 5 and 6, respectively. Bracket 28 may be referred to as a "front" bracket in that it is primarily useful along the front of the desk top in the areas indicated by the numerals 32 in FIG. 1. The bracket 28 is provided with hooks 34 and a "U"-shaped body member 36. Projecting outwardly from one leg of the U-shaped body member 36 is a flange 38 on which the desk top 26 is rested when the bracket is in place. The bracket is placed in position by inserting the hooks 34 into a pair of vertically adjacent slots 14 in a vertical side edge 16 of one of the panels 12. The hooks are provided with a wedge surface 40 which engages the inner walls of the metal channel member which defines the slots 14, by first pushing the hooks inwardly of the slot and then downwardly wherein the wedging surfaces operate against the inner walls and the channel member defining the slots to pull the bracket into tight engagement with the corner panel 12. A set screw 42 is then turned into engagement with the side edge of the corner panel 12 to further help retain the bracket in position.

Figure 6:
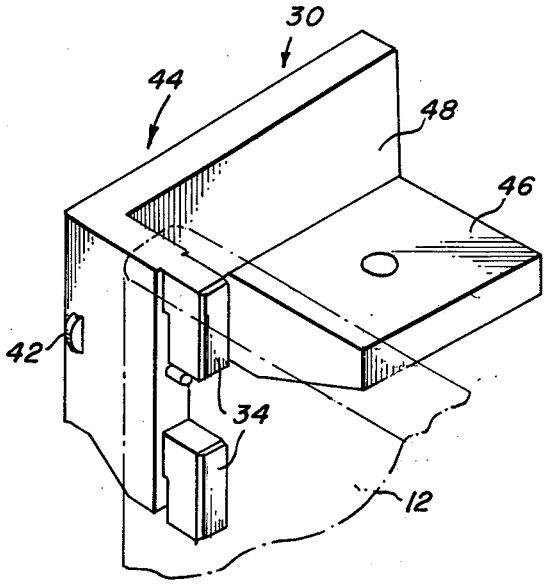
FIG. 6 is a perspective view of another bracket used in supporting a desk top on the generally L-shaped panels of the desk of this invention.

The bracket 30 shown in FIG. 6 may be referred to as a "rear" bracket and is received in the vertical side edges of the panels which are adjacent to the rear edge of the desk top. The structure of the bracket 30 is substantially similar to that of 28 except that instead of a U-shaped body member, it has an L-shaped body member 44 and a flange 46 extending horizontally inwardly from the free leg portion of the L-shaped body member. The rear edge of the desk top abuts side wall 48 such that the desk top is then restrained from movement by the side wall of the bracket 48 on one side and the L-shaped panels on the other sides. It is, of course, to be understood that there is a bracket in each of the vertical side edges of each of the L-shaped panels 12. In other words, there are two brackets 28 at points 32 and there are two brackets 30 at the rear side of the desk along the other vertical side edges of the panels 12.

Figure 7:
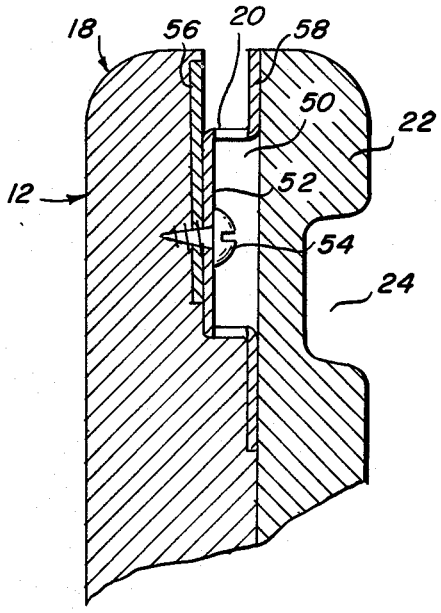
FIG. 7 is a partial cross-sectional view taken along lines 7—7 of FIG. 4.
Figure 8:
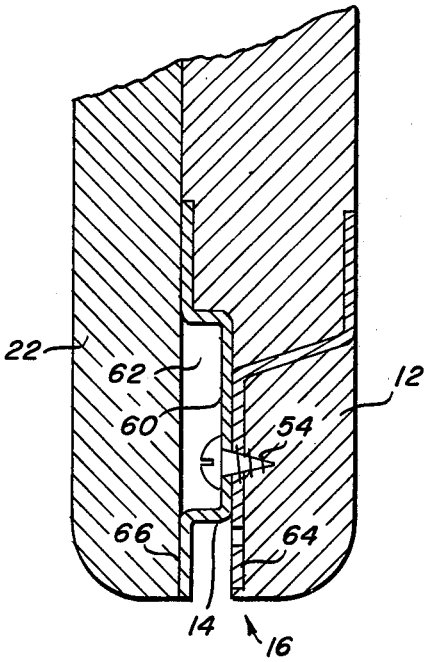
FIG. 8 is a partial cross-sectional view taken along lines 8—8 of FIG. 4.

The slot configuration is shown in greater detail in FIGS. 7 and 8. FIG. 7 shows a horizontal edge of a panel 12 and a portion of its liner 22. The panel 12 has an offset portion along the upper edge thereof defining a recess 50.

An elongated metal channel 52 having the slots 20 therein is seated in the recess 50 and is attached to the panel 12 by means of screw 54. An elongated metal strip 56 is recessed in that portion of the panel facing the channel to provide, along with the leg 58 of the member 52, wear-resistant surfaces for receipt of the hooks on the bracket members 28 and 30.

Similarly with respect to the vertical edge 16 of each panel, an elongated channel member 60 is seated in recess 62 formed between the liner 22 and the panel 12 and is affixed to the panel 12 by means of screw 54. A metal member 64, along with leg member 66 of channel member 60, form wear-resistant surfaces in the passageway leading to slots 14. Other arrangements can be employed other than those shown in FIGS. 7 and 8; however, these have been found to be satisfactory for the intended purpose.

As can be seen from the description above, the basic unit is relatively simple and consists of only a minimum of elements; namely, two L-shaped panels, a desk top and the supporting brackets. This basic unit can be expanded as shown in FIGS. 1 and 2 by the addition of another desk top to form a desk of an overall L-shaped configuration. Further various accessories both ornamental and functional can be added as desired.

With reference to FIG. 1, a supplementary desk top 100 extends at right angles to the desk top 26 and is supported at one end by a bracket affixed to rear vertical edge of the right-hand panel 12, and on the other end by an additional corner panel which is provided with the brackets 28 and 30 for supporting the top 100 in the manner specified earlier herein.

Additionally, depending upon the particular use to which the desk is to be put, other accessories can be attached thereto. If the user desires more privacy, additional panels 12 can be stacked upon the supporting panels in the manner shown in FIG. 2. These additional panels are supported by brackets 102 which are, in turn, received in slots 20 in the upper horizontal edges of the supporting panel members. The brackets 102 space the lower edges of the upper panels from the upper edges of the lower panels to provide an elongated slot 103 which permits access to said upper edges for purposes of attaching additional accessories. Further the slot 103 is useful for ventilation purposes.

As shown in FIGS. 1 and 2, a base 104 can be attached to the lower horizontal edges of each of the supporting panels 12 by suitable bracket means (not shown) receivable in the slots 20. The bases as shown are in an ornamental corrugated form; however, it is to be understood that any suitable base design may be employed, the only requirement being that it be readily attachable or removable from the panel member. Though preferable, the use of a base is not an absolute requirement. In such event, the panels will be constructed of a height necessary to support the desk top at normal desk height. When a base is employed, the height of the base and panel taken together will be of sufficient height.

A variety of accessories can be attached to the L-shaped panel members by means of brackets which are inserted in the slots 14 in the respective vertical side edges of the panels 12. By way of example, a number of accessories, both ornamental and functional, are shown in FIGS. 1 and 2. A bookholder 106 is positioned on the left side of the desk by means of brackets which are affixed to the lower portion of the bookholder and which are received in the slots 20 in the top edge of the left-hand panel 12. Likewise, a planter 108 is supported by brackets 110 which are affixed to one side of the planter and which have L-shaped tabs which extend into the slots 20 in the upper horizontal edge of the left-hand panel 12. A telephone holder 112 or a name plate 113 may be employed.

What may be referred to as a modesty panel 114 is readily affixed in the opening between adjacent panels 12 by means of brackets, similar to brackets 28 and 30, which are received in slots 14. A tiltable waste basket 117 is positioned between panels 12 and is pivotably supported on a rod (not shown) supported by the sides of the panels bordering the opening in which the basket is located. Trash is deposited in the basket through opening 119 in desk top 26.

With reference to FIG. 2, the planter 108 may be positioned between adjacent panels 12 by means of brackets similar to those required to support modesty panel 114. A shade or Venetian blind 116 is likewise supported between adjacent ends of the panels and a lamp 118 can be pivotally mounted by means of arm 120 which in turn is anchored in the slots 14 of one of the vertical side edges of a panel 12. An electrical outlet 122 is shown in FIG. 1 and is mounted on an upper horizontal edge of one of the panels by brackets which are receivable in the slots 20.

While the brackets are not shown with respect to each accessory, it is to be understood that where the accessories are supported by a vertical side edges, the bracket may be somewhat similar to brackets 28 and 30, at least with respect to configuration of the hooks. The accessories supported along the horizontal edges may be supported merely by means of spade-like prongs affixed to the accessory and which extend into the slots 20.

The particular shape and form of the brackets and the selection of the accessories employed can be varied without departing from the overall scope of the invention. It is to be understood that any of a number of different types of accessories may be employed within the basic concept of the subject invention.

Figure 9:
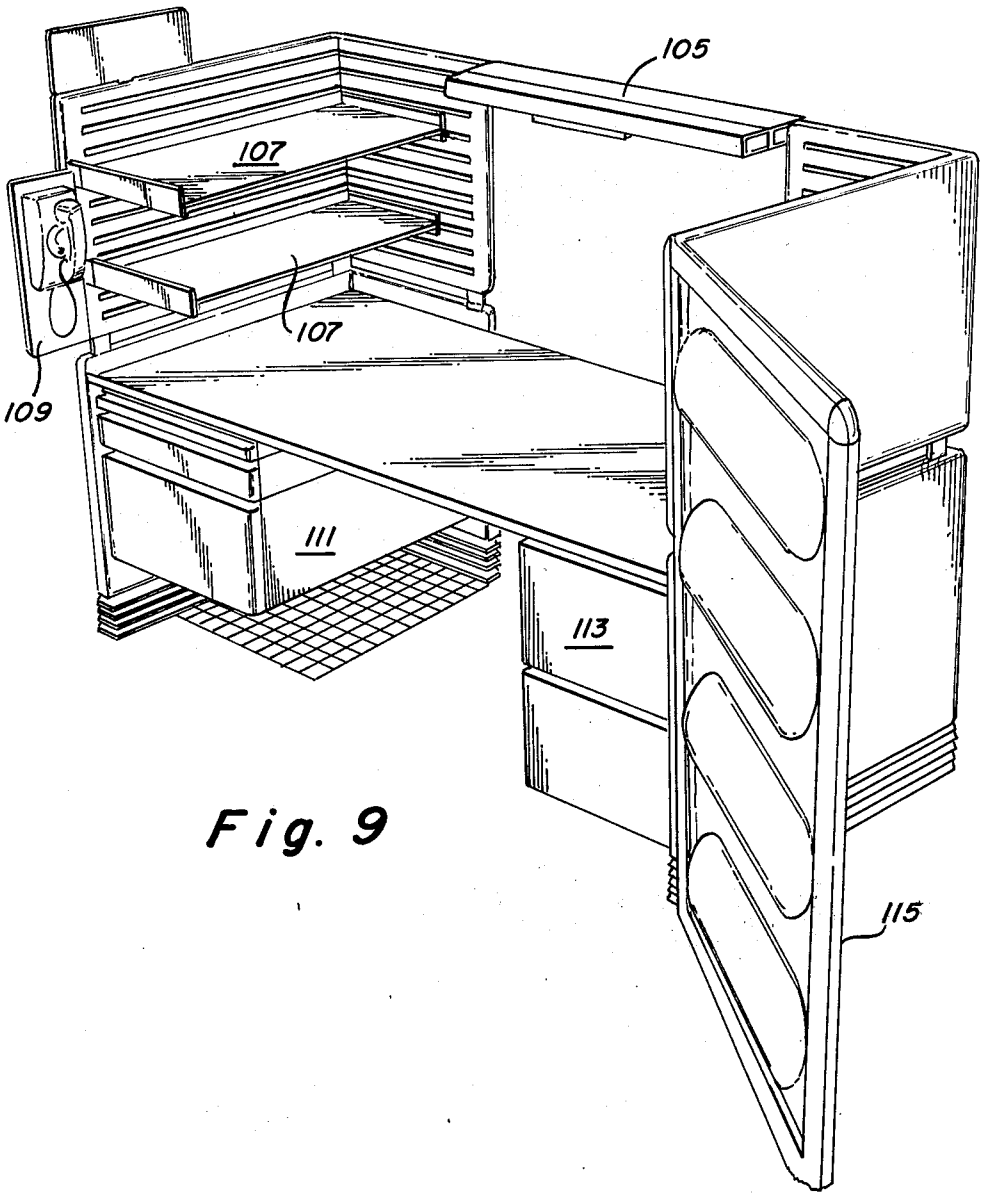
FIG. 9 is a perspective view of a modified desk of this invention.

The desk of FIG. 2 is shown in FIG. 9 but with different attachments and without the extension. Spanning the upper panels is a plugin lamp 105 in place of the Venetian blind shown in FIG. 2. Further, shelves 107 are added in suitable locations as shown in the Figure. Additionally, a phone holder 109 can be attached to one of the vertical side edges of one of the upper panels 12. Also, drawer units 111 and 116 may be suspended on the underside of the desk top by suitable brackets (not shown). A panel 115 is pivotally attached to the vertical side edges of the pair of stacked panels 12 as shown in FIG. 9 in such a manner that the panel may be swung to different positions to provide more of a cubicle effect, thereby affording more privacy.

Figure 10:
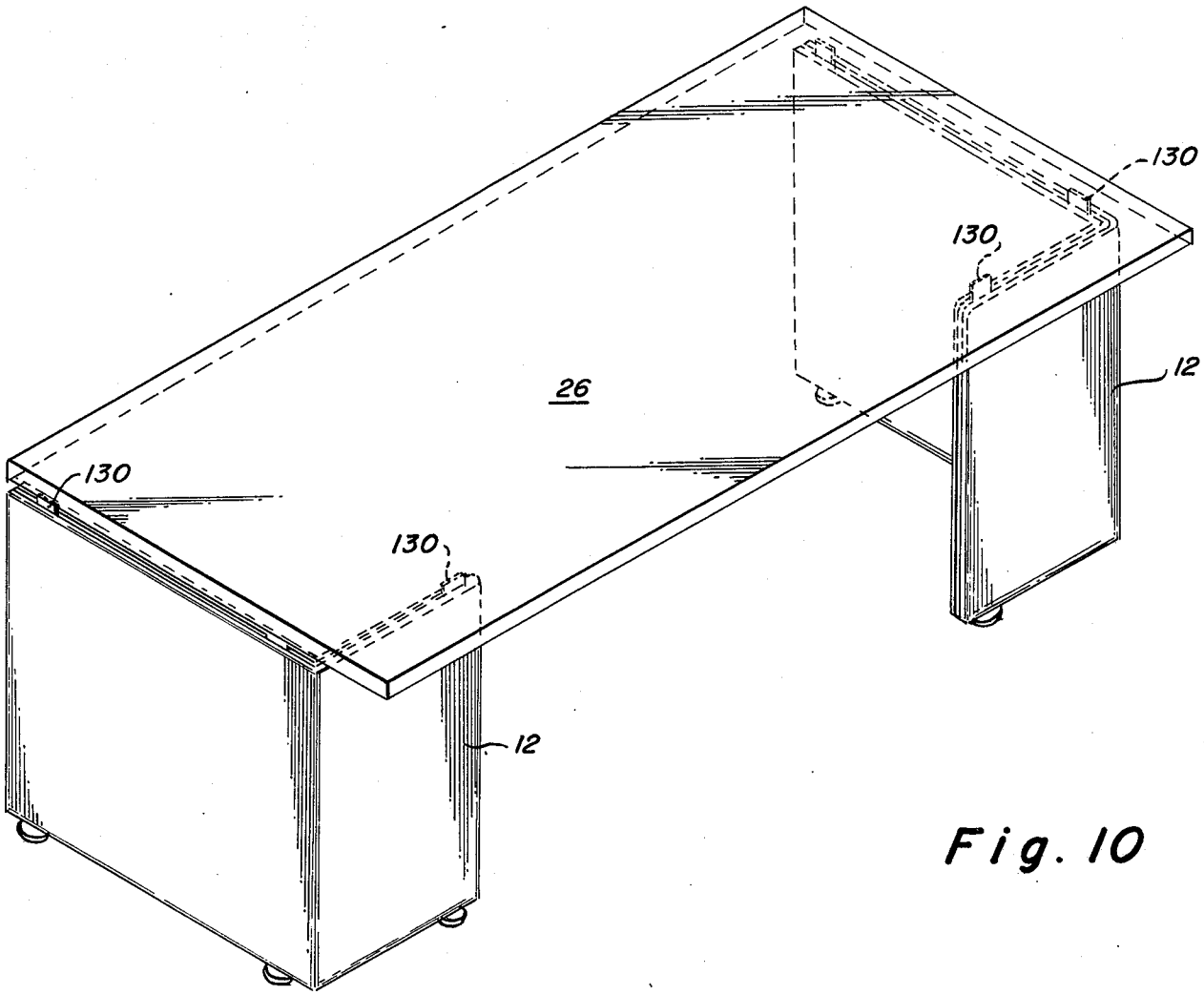
FIG. 10 is a perspective view of another modified desk of this invention.

Another modified form of the desk of this invention is shown in FIG. 10. Essentially, the only difference between the desk shown in FIG. 10 and the desks described earlier is that the corner panels 12 completely underlie the desk top 26. Brackets 130 of the type used with screws may be employed in the top horizontal edge portions of the panels 12 to assist in securing the top 26 in place.

The desk shown in FIG. 11 is substantially similar to the desk of FIG. 10 in that the panels 12 underlie the desk top 26. However, the panels are located more closely to the center of the underside of the table in a manner to provide what amounts to four legs extending radially from the center point.

Figure 12:
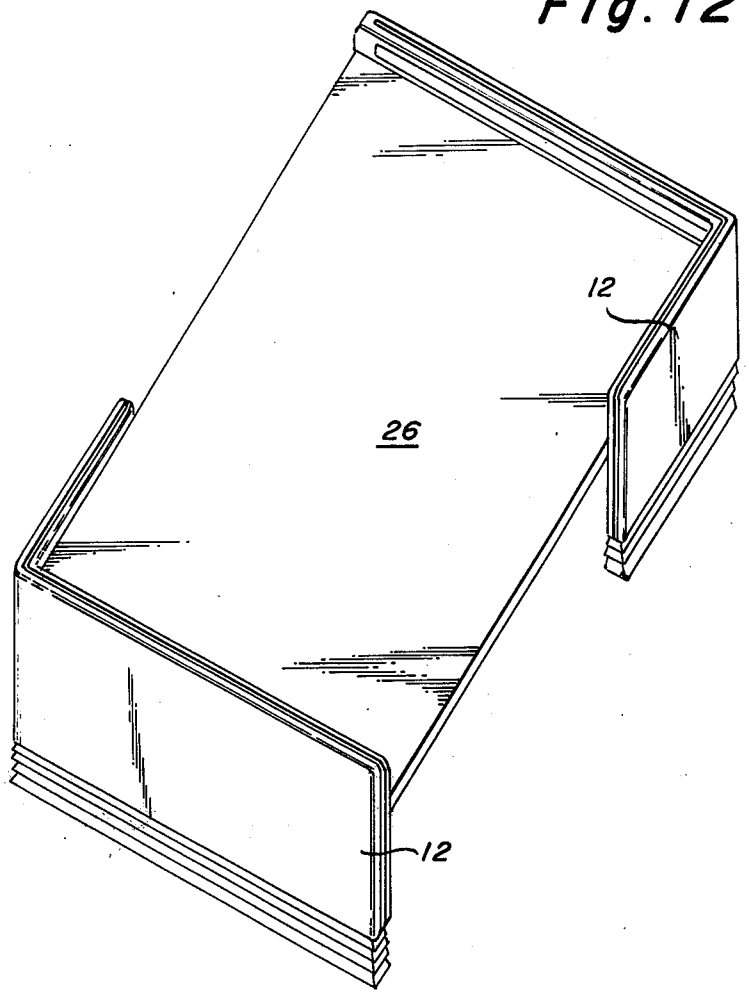
FIG. 12 is a perspective view of another modified form of the desk of this invention.

In FIG. 12, the desk shown therein is somewhat similar to the construction described with respect to FIG. 1 in that the desk top 26 is supported by panels 12 in a manner such that the panels 12 encompass a portion of the side edges of the desk top. The embodiment of FIG. 12 differs in that the panels are oriented such that two "left-hand" panels are utilized. Openings are provided on opposite sides of the desk top 26 and are staggered relative to each other. In this manner, two persons could use the desk, each sitting on the opposite side but not directly across from each other.

FIG. 13 shows a mobile cart arrangement wherein L-shaped panels are provided with casters 134. It is to be understood that the top 26 is supported by brackets as described earlier herein.

FIG. 14 shows a shelving arrangement including pairs of stacked panels 12 which, with brackets, form supports for shelving members 136.

Figure 15:
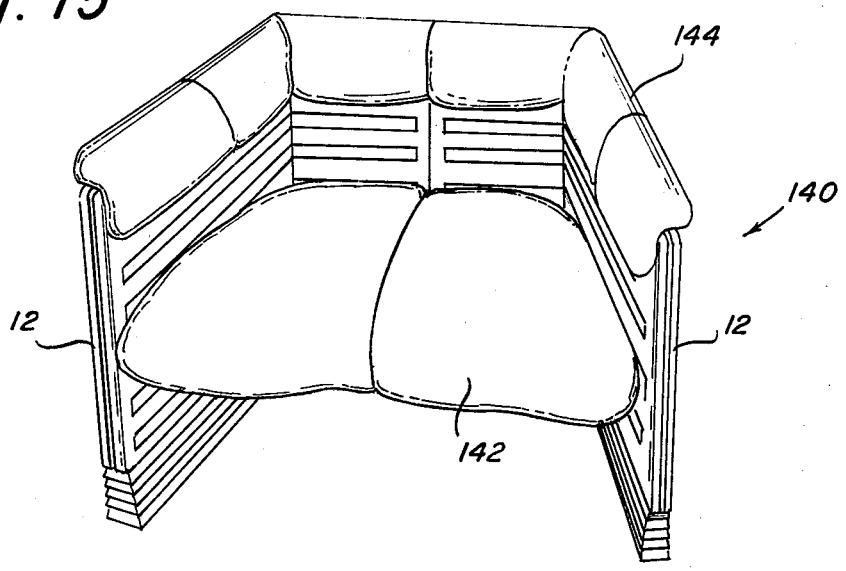
FIG. 15 is a perspective view of a chair.
Figure 16:
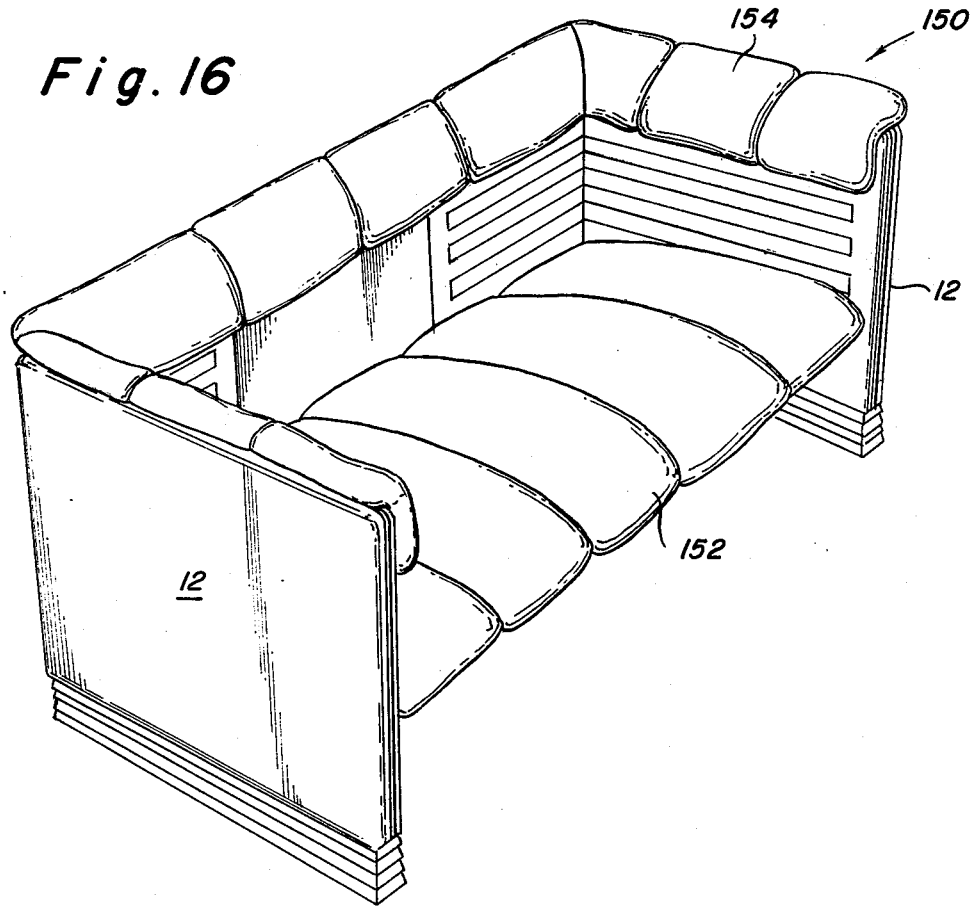
FIG. 16 is a perspective view of a sofa.

Illustrative of the versatility of the panels of this invention, FIG. 15 and FIG. 16 show a chair and sofa respectively, 140 and 150, assembled using essentially the same concept as that employed in assemblying the desk. The structure of FIG. 16 differs from that of FIG. 15 only in that the greater spacing is provided between the panels to provide a seat of greater length than that shown in FIG. 15. The chair or sofa is formed by supporting a planar member on the L-shaped panels by means of the brackets described earlier herein, but at "seat" level as opposed to desk-top level. The planar member is then covered by cushions 142 and 152 and the panels are provided with padding 144 and 154 as shown.

In summary, it can be seen that the furniture of this invention is extremely versatile and, with slight modification, can be rendered usable in a number of different situations. It can be readily disassembled to facilitate storage and shipment. It is lightweight and compact and because of the universal nature of the L-shaped panels, which can be used as either right-hand or left-hand panels by merely inverting same, the time and expense in the manufacturing process can be greatly reduced.

In a general manner, while there has been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. A universal component part for articles of furniture, said component part comprising a generally L-shaped free standing panel having upper and lower horizontal edges and left and right vertical edges, said panel comprising two generally planar members and elongated members seated in peripheral recesses formed in the exterior edges of said planar members and defining with said planar members and internal cavity, said panel having a first set of slots formed in the peripheral edges of said elongated members seated in the horizontal edges of said planar members and a second set of slots formed in the peripheral edges of said elongated members seated in the vertical edges of said planar members, said slots being sized and shaped to receive brackets which extend into said internal cavity and support other component parts of said articles of furniture.

2. A universal component part as recited in claim 1 wherein said elongated members are elongated channels.

3. In combination, (a) a universal component part for articles of furniture, said component part comprising a generally "L"-shaped free standing panel having upper and lower horizontal edges and left and right vertical edges, said panel comprising two generally planar members and elongated members seated in peripheral recesses formed in the exterior edges of said planar members and defining with said planar members an internal cavity, said panel having a first set of slots formed in the peripheral edges of said elongated members seated in the horizontal edges of said planar members and a second set of slots formed in the peripheral edges of said elongated members seated in the vertical edges of said planar members, and (b) at least one bracket comprising a "U"-shaped body member, at least two hooks carried by said body member and sized, shaped, and positioned to be received in two of said slots and to extend into said internal cavity, and a flange projecting outwardly from one leg of said "U"-shaped body member in position to carry another component part of said articles of furniture.

4. A combination as recited in claim 3 wherein said elongated members are elongated channels.

5. A combination as recited in claim 3 wherein each of said hooks is provided with a wedge surface which engages the inner walls of said elongated members, whereby by first pushing said hooks inwardly of said slots and then downwardly, said wedge surfaces operate against the inner walls of said members to pull said brackets into tight engagement with said panel.

6. In combination, (a) a universal component part for articles of furniture, said component part comprises a generally "L"-shaped free standing panel having upper and lower horizontal edges and left and right vertical edges, said panel comprising two generally planar members and elongated members seated in peripheral recesses formed in the exterior edges of said planar members and defining with said planar members an internal cavity, said panel having a first set of slots formed in the peripheral edges of said elongated members seated in the horizontal edges of said planar members and a second set of slots formed in the peripheral edges of said elongated members seated in the vertical edges of said planar members, and (b) at least one bracket comprising an "L"-shaped body member, at least two hooks carried by said body member and sized, shaped, and positioned to be received in two of said slots and to extend into said internal cavity, and a flange extending inwardly from the free leg portion of said "L"-shaped member in position to carry another component part of said articles of furniture.

7. A combination as recited in claim 6 wherein said elongated members are elongated channels.

8. A combination as recited in claim 6 wherein each of said hooks is provided with a wedge surface which engages the inner walls of said elongated members, whereby by first pushing said hooks inwardly of said slots and then downwardly, said wedge surfaces operate against the inner walls of said members to pull said brackets into tight engagement with said panel.

* * * * *